US005192825A

United States Patent [19]

Kunimoto

[11] Patent Number: 5,192,825

[45] Date of Patent: Mar. 9, 1993

[54] APPARATUS FOR SYNTHESIZING MUSICAL TONES

[75] Inventor: Toshifumi Kunimoto, Hamamatsu, Japan

[73] Assignee: Yamaha Corporation, Hamamatsu, Japan

[21] Appl. No.: 514,112

[22] Filed: Apr. 25, 1990

[30] Foreign Application Priority Data

Apr. 27, 1989 [JP] Japan ..... 1-108699

[51] Int. Cl.[5] ..... G10H 1/12

[52] U.S. Cl. ..... 84/661; 84/736; 84/DIG. 9; 331/78

[58] Field of Search ..... 84/622-625, 84/659-661, 697, 699, 700, 735, 736, DIG. 9, DIG. 10; 331/78; 364/717, 419

[56] References Cited

U.S. PATENT DOCUMENTS 3,767,833 10/1973 Noble et al. .
4,056,996 11/1977 Bunger ..... 84/DIG. 9
4,130,043 12/1978 Niimi ..... 84/622 X
4,736,663 4/1988 Wawrzynek et al. .
4,984,276 1/1991 Smith .

FOREIGN PATENT DOCUMENTS 63-40199 2/1988 Japan .

*Primary Examiner*—Stanley J. Witkowski
*Attorney, Agent, or Firm*—Graham & James

[57] ABSTRACT

An apparatus for synthesizing musical tones is provided with an excitation device and time delay device so as to form a loop circuit, and also, a noise generation device for generating a blowing noise signal when blowing a wind instrument, and noise mixing device for mixing the blowing noise signal with excitation signal corresponding to musical information output from the wind instrument are incorporated in the loop circuit, thereby the excitation signal is circulated in the loop circuit and mixed with the blowing noise signal.

7 Claims, 5 Drawing Sheets

APPARATUS FOR SYNTHESIZING MUSICAL TONES

BACKGROUND OF THE INVENTION

1. Field of the Invention

The present invention relates to a musical tone control apparatus capable of accurately reproducing musical tones with noises generated from wind instruments, stringed instruments, and the like.

2. Prior art

One type of conventional apparatus known in the art is disclosed in Japanese Patent Application Laid-open No. 63-40199 and Japanese Patent Publication No. 58-58679.

According to the documents, FIG. 1 shows a construction of an apparatus for mixing musical tones, the construction being used for simulating the musical tones based on musical tone generation mechanism. In FIG. 1, reference numeral 11 denotes a ROM (read-only memory), 12 denotes an adder, 13 denotes a subtractive device, 14 and 15 denote multipliers. Accordingly, the construction is formed so that the operation of a mouthpiece and a reed for the clarinet is simulated when the clarinet playing. The above construction thus comprises an excitation circuit 10.

Reference numeral 20 denotes a bi-directional transmission circuit so that transmission characteristic of a resonance tube of the clarinet is simulated. Transmission circuit 20 comprises delay circuits D, D, ... for simulating transmission delay of air-pressure waves from the resonance tube; junctions JU, JU, ... intervened between delay circuits D, D, etc.; a low-pass filter LPF for simulating energy loss when the air-pressure waves reflect at the end portion of the resonance tube; and a high-pass filter for eliminating direct-current component of data which is transmitted into bi-directional transmission circuit 20. Junctions JU, JU, etc. are used for simulating scattering air-pressure wave at the various diameter of the resonance tube.

FIG. 1 also shows four multipliers $M_1$ to $M_4$, and two adders $A_1$ and $A_2$, these being of a lattice-type circuits. Symbols "1+K", "−K", "1−K", and "K" beside multipliers $M_1$ to $M_4$ represent multiplication constants, in which "K" is determined so that the transmission characteristic close to that of actual resonance tube is obtained.

According to the above construction, data P corresponding to a blowing pressure is supplied to adder 12 and subtractive device 13. Output data from adder 12 is then transmitted to delay circuit D, junction JU, delay circuit D, and the like, in bi-directional transmission circuit 20, and then transmitted to low-pass filter LPF. After transmitting it through low-pass filter LPF and high-pass filter HPF, output data from adder 12 is conversely transmitted to delay circuit D, Junction JU, and the like, then supplied to subtractive device 13 from bi-directional transmission circuit 20.

In addition, data P is subtracted from output data output from bi-directional transmission circuit 20 by subtractive device 13, in which the data corresponds to a pressure of the air-pressure wave which is returned to a gap between the mouthpiece and reed from the end portion of resonance tube. By virtue of the subtraction, data $P_1$ corresponding to the air-pressure of the gap between the mouthpiece and reed is obtained. Supplying data $P_1$ to ROM 11 generates data Y corresponds to "admittance", that is, it means a degree how air easily flows into the resonance tube, in other words, the data Y corresponding to a sectional area of the gap between the mouthpiece and reed from ROM 11.

FIG. 2 shows a characteristic of non-linear function "A" which represents the air-pressure of the gap between the mouthpiece and reed stored in ROM 11 related to the sectional area of the gap.

In addition, data Y is multiplied by data $P_1$ in multiplier 14, so that data FL corresponding to a speed of air flow which is passed through the gap between the mouthpiece and reed is obtained. Data FL is then multiplied by multiplication constant G in multiplier 15, in which the multiplication constant G is a constant which is determined by various diameters of the instrument in the vicinity of the reed, i.e., the constant G expresses resistance to air flow in the vicinity of the reed, such as a "impedance". Accordingly, data $P_2$ is obtained from multiplier 15, and represents a value which is multiplied the speed of the air flow passing through the gap between the mouthpiece and reed by the "impedance" against the air flow in the tube, that is, the data $P_2$ represents a magnitude of pressure changes in the tube when air passing through the gap. Data $P_2$ is then added to data P by adder 12, and then, the sum is supplied to bidirectional transmission circuit 20.

Accordingly, in a closed loop formed between excitation circuit 10 and bi-directional transmission circuit 20, data is circulated in the closed loop, that is, resonance operation is carried out. Data at the point of low-pass filter LPF in bi-directional transmission circuit 20 is then extracted from the apparatus, so that a musical tone is generated in accordance with the data.

On the other hand, in a wind instrument, when air blowing into the gap between the mouthpiece and the reed, a blowing noise is generated from the gap, thereby mixing the blowing noise with the data.

Conventionally, mixing the blowing noise and the data has been carried out so as to overlap data P corresponding to the blowing pressure with data corresponding to the blowing noise.

FIG. 3 shows an apparatus for mixing musical tones generated from both stringed and percussion instruments. In FIG. 3, reference numeral 101 denotes a ROM for storing an initial wave form, for example, first one-cycle of an immediately after musical tone which is generated from the stringed or percussion instrument. Reference numeral 102 denotes a delay circuit, 103 denotes a selection circuit, and 104 denotes a filter.

The apparatus for mixing musical tones begins operating in accordance with a musical tone generation instruction output from a musical tone generation instructor (not shown). When the apparatus receives the musical tone generation instruction outputted from the musical tone generation instructor, selection circuit 103 transmits one-cycle of wave data from ROM 103 to an output portion, and to filter 104. Also, the one-cycle wave data in which the band-width is limited by filter 104, is supplied to delay circuit 102. Afterwards, the one-cycle wave data is circulated in the circuits in the order of selection circuit 103, filter 104, and delay circuit 102, and is transmitted to the output portion at every circulation. According to the above construction, musical tones are mixed with each other so that tone colors are changed in accordance with the elapsed time when the stringed and percussion instruments are played.

When the stringed and percussion instruments are played, it is known that noise overlap with each of the musical tones in the beginning of play in case of the stringed instrument, and also in case of hitting the percussion instrument. However, the conventional apparatus for mixing musical tones does not generate such noise.

According to the above-mentioned, the method for reproducing noises in which the noise overlaps data corresponding to the blowing pressure of the wind instrument is not suitable for the generation of actual noise, in other words, the noise is not natural.

SUMMARY OF THE INVENTION

In consideration of the above described problems, it is an object of the present invention to provide an apparatus for mixing musical tones, which can accurately reproduce noise in playing musical instruments based on a noise generation mechanism.

In an aspect of the present invention, there is provided an apparatus for mixing musical tones including an excitation device for generating an excitation signal corresponding to performance information output from a musical instrument, a time delay device for delaying the excitation signal in accordance with a transmission characteristic of the performance information, wherein the time delay device is coupled with the excitation device to form a loop circuit for circulating the excitation signal therebetween, thereby the circulated excitation signal is used as a musical tone signal, in which the improvement comprises a noise generation device for generating a noise signal when playing the musical instrument a and noise mixing device for mixing the circulated excitation signal in which with the noise signal, the noise mixing device is incorporated in the loop circuit.

Accordingly, first feature of the present invention is that the noise generation and noise mixing devices are incorporated in the loop circuit, therefore a noise signal, for example, a blowing noise signal output from a wind instrument is mixed with an excitation signal, such as a blowing signal, during the circulation of the excitation signal, so that the natural noise signal can be accurately reproduced.

A second feature of the present invention is that, in the noise mixing device, the speed of the air flow at the sound generation portion of the wind instrument is obtained from the air-flow speed signal generation device when the latter device receives the blowing-pressure signal output from the blowing-pressure signal generation device and the air flow signal output from the air-flow signal generation device, thereby circulating the speed of the air flow, mixing the latter with the noise signal, and accurately reproducing the natural noise signal.

A third feature of the present invention is that, in the noise mixing device, the speed of the air flow is obtained from the air-flow speed signal generation device when the latter device receives the air flow signal output from the air-flow signal generation device and the point of air-speed saturation output from the air-speed saturation detecting device, thereby circulating the speed of the air flow, mixing the latter with the noise signal to reproduce the natural noise signal.

DETAILED DESCRIPTION OF THE PREFERRED EMBODIMENTS

Figure 1:
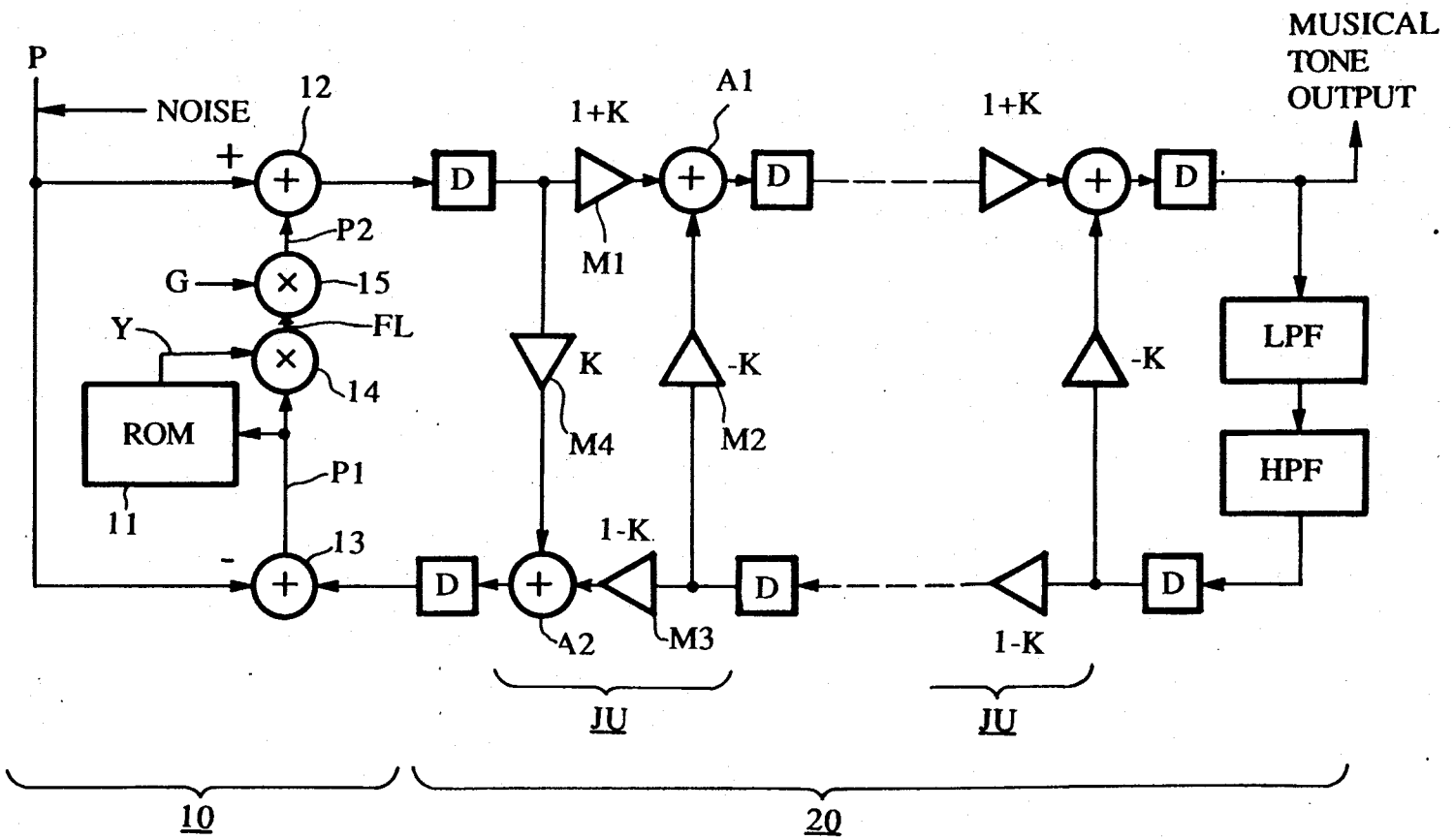
FIG.1 (PRIOR ART)
FIG. 1 is a block diagram showing a conventional apparatus for mixing musical tones.
Figure 4:
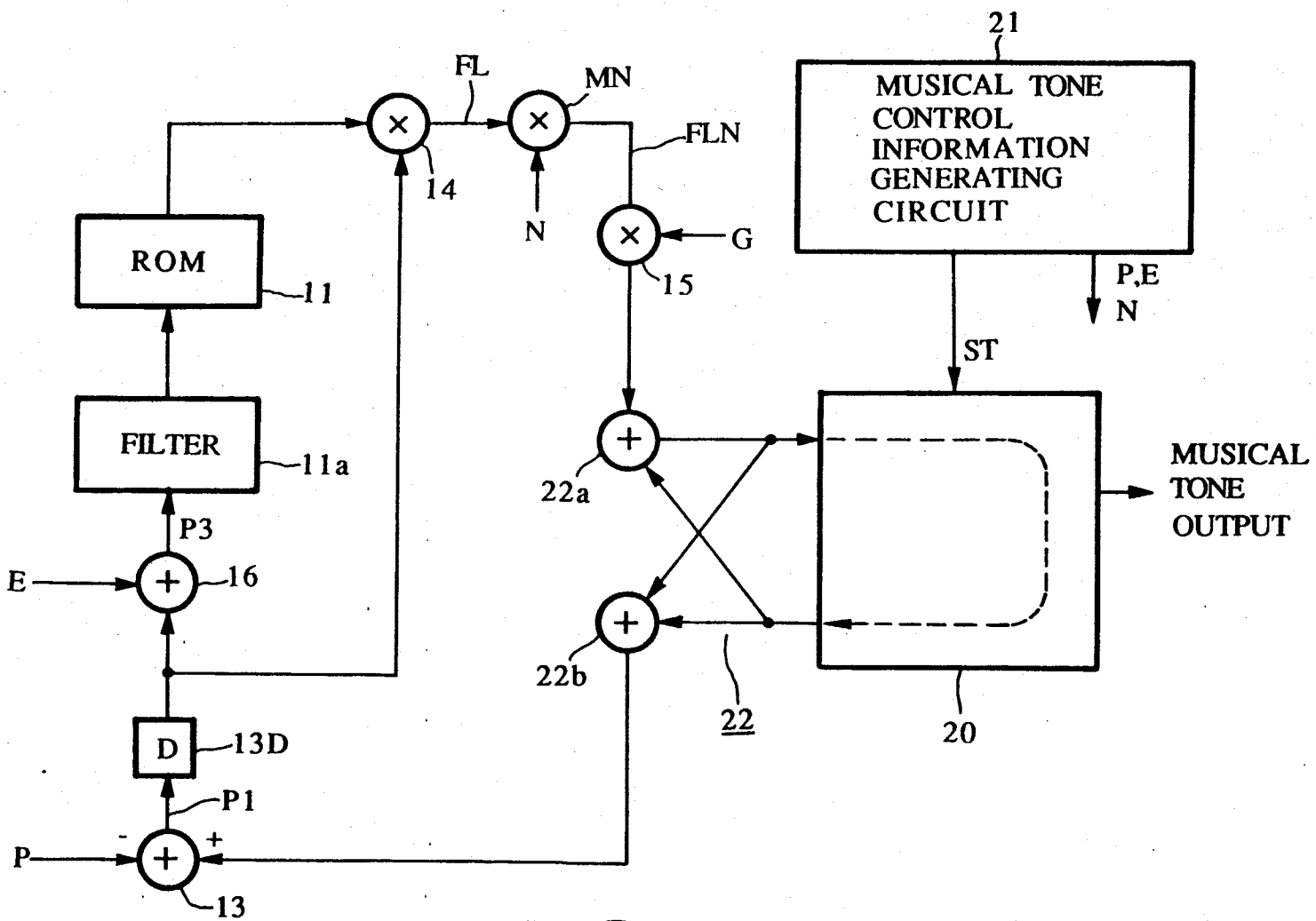
FIG. 4 is a block diagram showing an apparatus for mixing musical tones in accordance with the first embodiment of the present invention.

Hereinafter, embodiments of the present invention are described with reference to drawings. FIG. 4 shows a block diagram of an apparatus for mixing musical tones of first embodiment. Since the block diagram includes constructions similar to conventional constructions shown in FIG. 1 which has been already described above, the same reference numerals in FIG. 1 are used in FIG. 4 for the same constructions and detailed descriptions for these are omitted.

In FIG. 4, reference numeral 21 denotes a musical tone control information generating circuit for generating various musical tone control information by detecting a type of operation corresponding to an operational element which is stored in the apparatus for mixing musical tones. The musical tone control information includes data P corresponding to the blowing pressure; data E corresponding to a pressure applied to the reed when a player holds the mouthpiece in his or her mouth, in which the pressure is referred to as "embouchure"; data ST for controlling a tone pitch of generated musical tone; noise data N; and the like.

Data ST for controlling the tone pitch is transmitted to bi-directional transmission circuit 20. Data ST changes a transmission line characteristic to another for bi-directional transmission circuit 20, thereby changing resonance characteristic of bidirectional transmission circuit 20 into another to provide the desired pitch.

Noise data N is used for simulating air turbulence at the gap between the mouthpiece and reed. Noise data N is obtained, for example, from an M-series random number generation circuit which generates dummy random number data. The dummy random number data is passed through the low-pass filter or the like, for eliminating a higher harmonic component, and then added to data corresponding to a direct current off-set component to the dummy random number data. Noise data N may also be obtained from another method, namely, a thermal noise generated from a zener diode is amplified by an amplifier from which an amplified output is converted from an analog into a digital signal.

Junction 22 comprises adders **22*a* and 22*b*. In junction 22, output data from multiplier 15 is added to that from bidirectional transmission circuit 20 by adder 22*a*, and then, the sum is supplied to bi-directional transmission circuit 20. Also, output data from bi-directional transmission circuit 20 is added to that from adder 22a by adder 22b, and the sum is supplied to subtractive device 13**. Accordingly, the turbulence of the air-pressure wave at the end portion of the mouthpiece can be simulated.

Data P corresponding to the blowing pressure is supplied to subtractive device 13, and feedback data from bidirectional transmission circuit 20 is also supplied to subtractive device 13 through adder 22b of junction 22, in which the feedback data corresponds to the air-pressure wave which is returned to the mouthpiece from the end portion of the resonance tube by reflection. Data Pl corresponding to the air-pressure at the gap between the mouthpiece and reed is then output from subtractive device 13, and supplied to both adder 16 and multiplier 14 through delay circuit 13D.

In addition, data E corresponding to an "embouchure" is added to data $P_1$ by adder 16, as an off-set component, and data $P_3$ corresponding to a pressure actually applied to the reed is then generated from adder 16. The band-width of data $P_3$ is limited by filter 11a, and then it is supplied to ROM 11.

Data $P_3$ is passed through filter 11a. In case of changing a pressure applied to the reed, the reed reacts to pressure changes with time delay by virtue of inertia peculiar to the reed. In the case where frequency of the pressure changes is high, the reed does not react to the pressure changes. Accordingly, the variation of the reed is simulated with respect to the pressure changes. Because of this, the band-width of data $P_3$ is limited by filter 11a to realize a natural wind instrument property.

Data Y corresponding to "admittance" with respect to the air flow at the gap between the mouthpiece and reed is then output from ROM 11. Data Y is multiplied by data Pl outputted from delay circuit 13D in multiplier 14 for generating data FL corresponding to the speed of the air flow which passes through the gap between the mouthpiece and reed.

Data FL is multiplied by noise data N in multiplier MN, thereby data FL is mixed with noise component of noise data N which is changed at every moment, in which the noise component is a component of remainder which is eliminated the off-set component from noise data N. Data FLN mixed with data corresponding to the air turbulence is outputted from multiplier MN, and is multiplied by the above-mentioned multiplication constant G in multiplier 15. By virtue of the multiplication, data corresponding to the air-pressure in the resonance tube is obtained, and supplied to bi-directional transmission circuit 20 through adder 22a of junction 22. Output data from bi-directional transmission circuit 20 is then supplied to adder 22b through junction 22 with mixture of signal from the adder 22a to thereby be supplied to the adder 13. And then, the above-mentioned signal process is carried out.

According to the apparatus for mixing musical tones, data corresponding to the speed of the air flow which passes through the gap between the mouthpiece and reed is mixed with noise data N, so that signal process is carried out in accordance with the actual noise generation mechanism of the wind instrument. As a result, the noise generated from the wind instrument is accurately reproduced.

In the first embodiment, output data from multiplier 14 is multiplied by noise data N, but the following data can be used as a multiplicand; data supplied from delay circuit 13D to multiplier 14; data output from delay circuit 13D; and data which is multiplied data supplied from ROM 11 to multiplier 14 by noise data N. Also, output data from multiplier 14 is multiplied by noise data N to mix data with the noise data N in this embodiment, but the output data from multiplier 14 can be added to noise data N.

Figure 5:
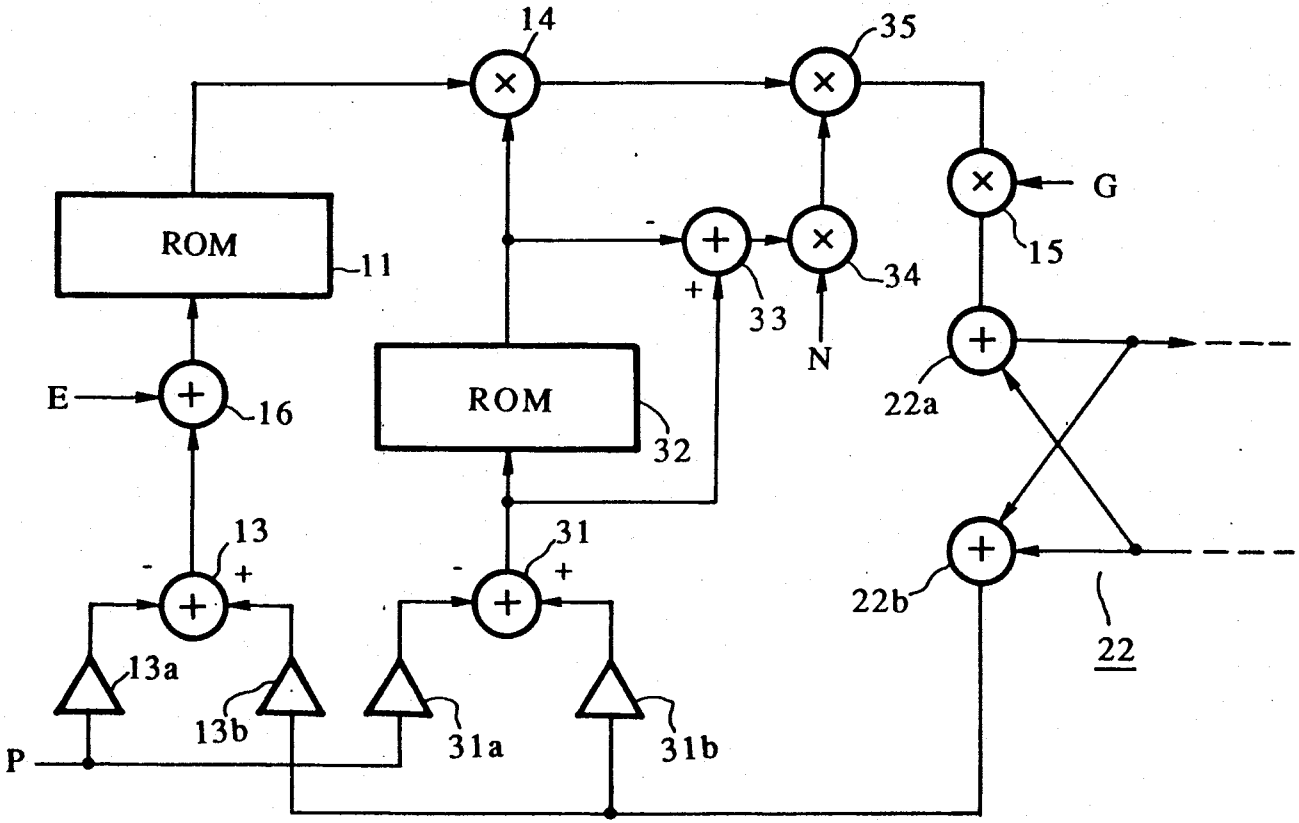
FIG. 5 is a block diagram showing another apparatus for mixing musical tones in accordance with the second embodiment of the present invention.

FIG. 5 shows a block diagram of another apparatus for mixing musical tones in accordance with second embodiment of the present invention. The same reference numerals in FIG. 4 are used in FIG. 5 for the same constructions. Reference numeral 32 denotes a ROM, 31 and 33 denote subtractive devices, 34 and 35 denote multipliers. Also, reference numeral 13a denotes a buffer for buffering and transmitting data P to subtractive device 13. Reference numeral 13b denotes a buffer for buffering and transmitting output data from bi-directional transmission circuit 20 to subtractive device 13. Reference numeral 31a denotes a buffer for buffering and transmitting data P to subtractive device 13. Also, reference numeral 31b denotes a buffer for buffering and transmitting output data from bi-directional transmission circuit 20 to subtractive device 13.

Figure 6:
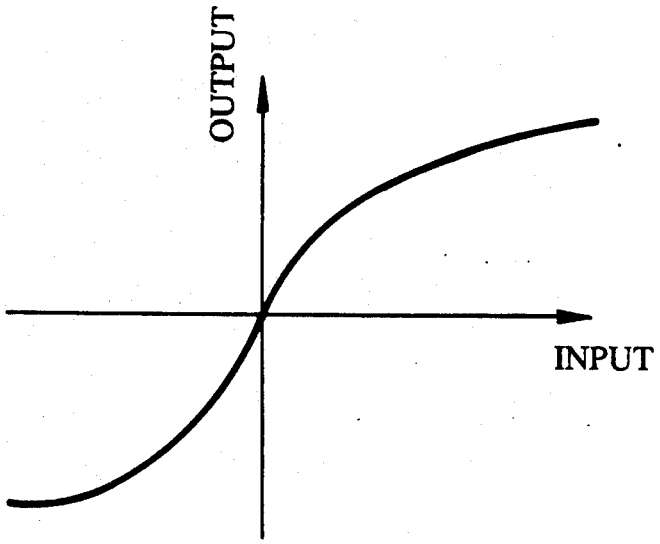
FIG. 6 is a graph showing a non-linear function "B" indicated by the saturated region and non-saturated region of the air flow speed at the gap between the mouthpiece and reed.

In such case, the speed of air flow at the gap between the mouthpiece and the reed is varied, but reaching a prescribed speed is saturated. FIG. 6 shows a non-linear function "B" which indicates a saturation characteristic for the speed of the air flow. The saturation characteristic is stored, as table data, in ROM 32.

In the second embodiment, output data from subtractive device 31 is supplied to ROM 32, and converted into data by the table data based on the non-linear function "B", in which output data from subtractive device 31 is data which corresponds to a pressure applied to the reed. Output data from ROM 32 is multiplied by output data from ROM 11 in multiplier 14 to obtain data which corresponds to the speed of the air flow at the gap in which output data from ROM 11 is data which corresponds to "admittance" with respect to the flow at the gap between the mouthpiece and the reed. Accordingly, in the case that output data from subtractive device 31 is relatively large, data corresponding to a saturation region of the non-linear function "B" is read from ROM 32. As a result, output data corresponding to the speed of the air flow is read out from multiplier 14 in saturation.

In the second embodiment, a process is carried out so that data corresponding to air turbulence becomes a larger value with saturation of the air flow speed.

The operation is described next. From the non-linear function "B" it can be seen that a difference between an input value and an output value becomes larger s a point of the characteristic moves from a non-saturation to the saturation region. In this embodiment, the difference is obtained from subtractive device 33, and also output data from subtractive device 33 is multiplied by noise data N in multiplier 34. Accordingly, in the case that data of the non-saturation region is read out from ROM 32, that is, the speed of the air flow is not saturated, output data from multiplier 34 becomes a small value. On the other hand, in the case that data of the saturation region is read out from ROM32, that is, the speed of the air flow is saturated, output data from multiplier 34 becomes a large value.

Output data from multiplier 34 is multiplied by output data from multiplier 14 in multiplier 35 to obtain data corresponding to the speed of the air flow including air turbulence, thereby generating musical tone including noise as described in the first embodiment. Accordingly, in playing the wind instrument, when the speed of the air flow at the gap between the mouthpiece and reed is saturated by blowing air strongly, a larger noise can be accurately reproduced.

Figure 3:
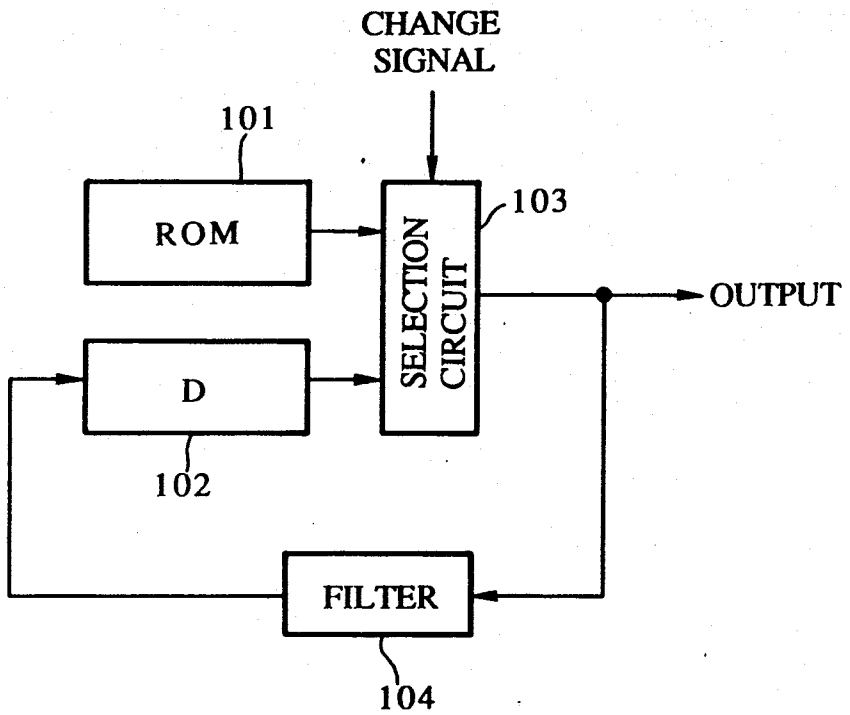
FIG. 3 (PRIOR ART)
FIG. 3 is a block diagram showing another conventional apparatus for mixing musical tone of a stringed instrument with that of a percussion instrument.
Figure 2:
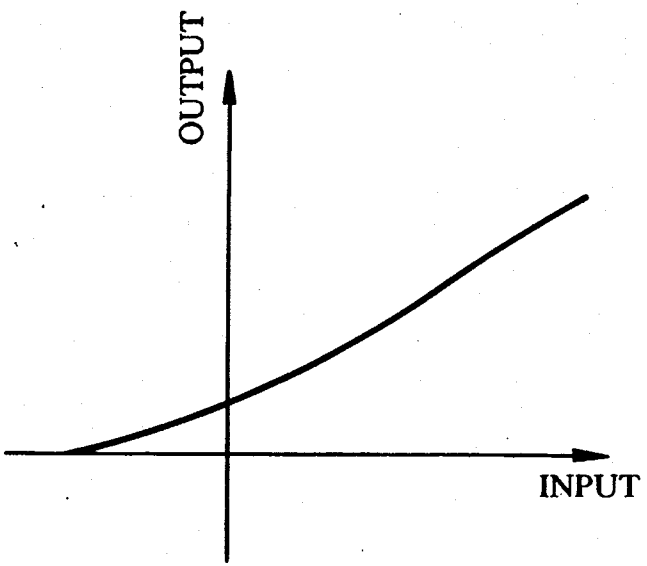
FIG. 2 (PRIOR ART)
FIG. 2 is a graph showing a non-linear function "A" indicated by an air-pressure at the gap between the mouthpiece and reed as the input component related to a sectional area at the gap as the output component.
Figure 7:
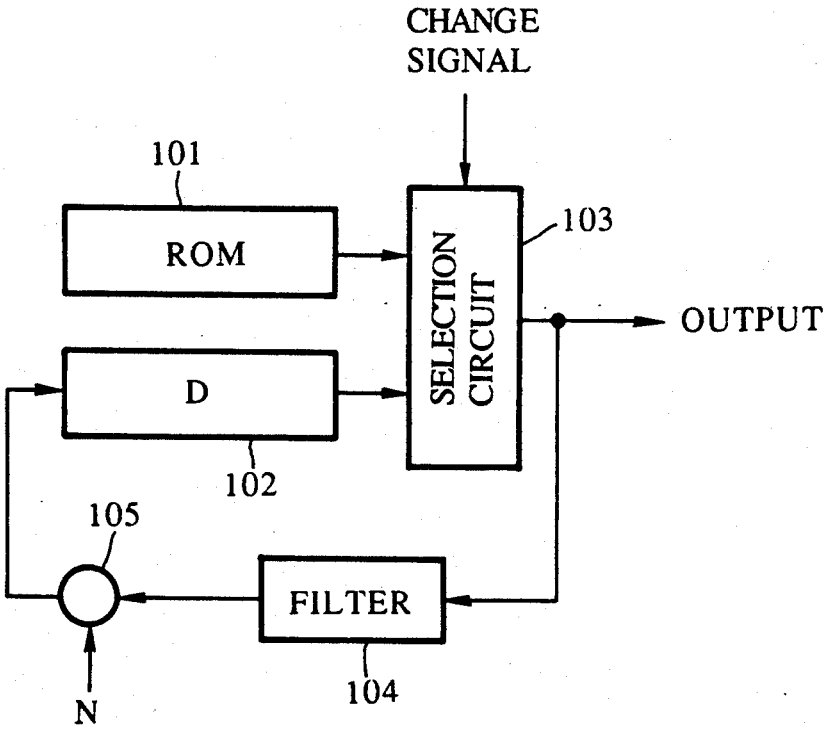
FIG. 7 is a block diagram showing another apparatus for mixing musical tones in accordance with the third embodiment of the present invention.

FIG. 7 shows a block diagram of an apparatus for mixing musical tones in accordance with third embodiment of the present invention. In FIG. 7, multiplier 105 is incorporated in the conventional apparatus as shown in FIG. 3 which has been already described. The feature of the third embodiment is that noise data N is overlapped with musical tones which are generated from the stringed and percussion instruments when mixing these musical tones.

The preferred embodiments described herein are illustrative and not restrictive. The scope of the invention is indicated by the appended claims and all variations which fall within the claims are intended to be embraced therein.

What is claimed is:

1. An apparatus for synthesizing musical tones comprising;

means for providing performance information corresponding to at least one parameter of a tone to be synthesized;

excitation means for generating an excitation signal in response to performance information and a feedback signal;

delay means for delaying the excitation signal in accordance with a transmission characteristic corresponding to the performance information, wherein an output of the delay means is provided as the feedback signal to the excitation means to form a loop circuit for circulating the excitation signal, wherein the circulated excitation signal is used as a musical tone signal;

noise generation means for generating a noise signal; and noise combining means contained in the loop circuit for combining the circulated excitation signal with the noise signal separate from the performance information, thereby causing the musical tone signal to have a noise component.

2. An apparatus according to claim 1, in which the apparatus is used for synthesizing tones simulating a wind instrument wherein the noise generation means generates the noise signal corresponding to air turbulence produced when the wind instrument is blown; and noise combining means combines the noise signal with the circulated excitation signal to simulate sound produced when blowing the wind instrument.

3. An apparatus according to claim 2, wherein performance information includes a blowing pressure signal representing a magnitude of blowing pressure applied to the wind instrument and an embouchure signal representing a mouth pressure applied to the wind instrument, wherein the excitation means comprises:

gap pressure signal generation means for generating a signal corresponding to magnitude of pressure at a sound generation portion of the wind instrument as a function of the blowing pressure signal and the feedback signal;

air flow signal generation means for generating a magnitude of an air flow at the sound generation portion as a function of the magnitude of the gap pressure at the sound generation portion and the embouchure signal; and air-flow speed signal generation means for generating a speed of the air flow at the sound generation portion as a function of the magnitude of the gap pressure at the sound generation portion and the magnitude of air flow, wherein the air-flow speed signal is combined with the noise signal by the noise combining means.

4. An apparatus according to claim 3, in which the air-flow signal generation means includes a filtering means for filtering a signal of the air flow at the sound generation portion to limit a band-width of the signal.

5. An apparatus according to claim 2, wherein performance information includes a blowing pressure signal representing a magnitude of blowing pressure applied to the wind instrument and an embouchure signal representing a mouth pressure applied to the wind instrument, wherein the excitation means comprises:

gap pressure signal generation means for generating a signal corresponding to magnitude of pressure at a sound generation portion of the wind instrument as a function of the blowing pressure signal and the feedback signal;

air flow signal generation means for generating a magnitude of an air flow at the sound generation portion as a function of the magnitude of the gap pressure at the sound generation portion and the embouchure signal;

air-speed saturation detecting means for detecting a region of air-speed saturation as a function of the magnitude of pressure at the sound generation portion and;

air-flow speed signal generation means for generating a signal corresponding to speed of the air flow at the sound generation portion as a function of the magnitude of the air flow at the sound generation portion and the magnitude of pressure at the sound generation portion, wherein the combining means combines the air-flow speed signal with the noise signal and includes means for controlling the amount of the noise signal to be combined as a function of the air speed saturation detecting means.

6. An apparatus according to claim 2 wherein the performance information includes information corresponding to blowing pressure applied to the wind instrument and wherein the apparatus further includes:

saturation means for determining a saturation characteristic of the excitation signal as a function of the blowing pressure; and control means for increasing the amount of noise to be combined with the excitation signal as the degree of saturation increases.

7. An apparatus according to claim 1 wherein the combining means comprises multiplying means for multiplying the circulated excitation signal by the noise signal.

* * * * *